US012060726B2

(12) United States Patent
Lacy

(10) Patent No.: US 12,060,726 B2
(45) Date of Patent: Aug. 13, 2024

(54) VARIABLE TEMPORARY STRUCTURE

(71) Applicant: Bijou Corp., Camden, ME (US)

(72) Inventor: Amanda Lacy, Camden, ME (US)

(73) Assignee: Bijou Corp., Camden, ME (US)

( * ) Notice: Subject to any disclaimer, the term of this patent is extended or adjusted under 35 U.S.C. 154(b) by 315 days.

(21) Appl. No.: 17/547,223

(22) Filed: Dec. 10, 2021

(65) Prior Publication Data

US 2023/0184000 A1 Jun. 15, 2023

(51) Int. Cl.

| | |
|---|---|
| ***E04H 15/48*** | (2006.01) |
| ***A63H 33/00*** | (2006.01) |
| ***E04H 15/00*** | (2006.01) |
| ***E04H 15/24*** | (2006.01) |
| ***E04H 15/54*** | (2006.01) |
| ***E04H 15/64*** | (2006.01) |

(52) U.S. Cl.

CPC ..... *E04H 15/48* (2013.01); *A63H 33/008* (2013.01); *E04H 15/006* (2013.01); *E04H 15/24* (2013.01); *E04H 15/54* (2013.01); *E04H 15/64* (2013.01)

(58) Field of Classification Search

CPC ..... E04H 15/24; E04H 15/26; E04H 15/28; E04H 15/322; E04H 15/006; E04H 15/48

See application file for complete search history.

(56) References Cited

U.S. PATENT DOCUMENTS

| | | | | |
|---|---|---|---|---|
| 828,488 A | | 8/1906 | Lanz | |
| 842,672 A | * | 1/1907 | Kirby | E04H 15/48 135/147 |
| 1,806,454 A | * | 5/1931 | Goudeau | A47D 13/101 5/127 |
| 2,001,196 A | * | 5/1935 | Jost | E04H 15/28 135/120.3 |

(Continued)

FOREIGN PATENT DOCUMENTS

| | | | |
|---|---|---|---|
| CN | 106988418 A | | 7/2017 |
| CN | 109779383 A | * | 5/2019 |

(Continued)

OTHER PUBLICATIONS

International Search Report and Written Opinion of the International Searching Authority in relation to International Application No. PCT/US2022/052476, dated Apr. 25, 2023, 7 pages.

*Primary Examiner* — David R Dunn
*Assistant Examiner* — Danielle Jackson
(74) *Attorney, Agent, or Firm* — Bochner PLLC; Andrew D. Bochner

(57) ABSTRACT

Provided may be a temporary structure comprising a junction assembly comprising a hub, wherein the hub is an annular member; a plurality of hinges, each of the plurality of hinges disposed on the hub; and a plurality of brackets, each of the brackets swivably attached to each of the plurality of hinges, each of the brackets having a first tine, a second tine, and a top wall. The temporary structure may further comprise a plurality of posts, each of the plurality of (Continued)

posts having a post top end and a post bottom end; a plurality of feet, each of the plurality of feet comprising a foot column and a base, wherein each of the plurality of feet are sized to accept the post bottom end and each of the plurality of brackets are sized to accept the post top end; and a plurality of panels.

18 Claims, 8 Drawing Sheets

(56) References Cited

U.S. PATENT DOCUMENTS

| | | | | |
|---|---|---|---|---|
| 4,029,117 | A * | 6/1977 | Rain | E04H 15/322 135/147 |
| 7,861,736 | B2 * | 1/2011 | Choi | E04H 15/48 135/905 |
| 8,047,218 | B1 * | 11/2011 | Shin | E04H 15/48 135/147 |
| 8,485,208 | B2 * | 7/2013 | Seo | E04H 15/48 135/147 |
| 8,955,286 | B2 | 2/2015 | Gadd | |
| 9,574,366 | B2 * | 2/2017 | Choi | E04H 15/32 |
| 9,650,805 | B2 * | 5/2017 | Choi | E04H 15/48 |
| 10,337,204 | B2 * | 7/2019 | Choi | E04H 15/32 |
| D998,080 | S * | 9/2023 | Lacy | D21/839 |
| 2003/0029490 | A1 | 2/2003 | Price et al. | |
| 2008/0047597 | A1 | 2/2008 | Rothweil | |
| 2015/0167343 | A1 * | 6/2015 | Fang | E04H 15/32 135/120.3 |

FOREIGN PATENT DOCUMENTS

| | | | | |
|---|---|---|---|---|
| CN | 112302411 | A * | 2/2021 | E04H 15/48 |
| CN | 112459607 | A * | 3/2021 | E04H 15/48 |
| KR | 200338116 | Y1 | 1/2004 | |
| KR | 101700691 | B1 * | 1/2017 | |

* cited by examiner

VARIABLE TEMPORARY STRUCTURE

FIELD OF INVENTION

The invention is in the field of temporary structures, specifically apparatuses and methods that enable collapsible temporary structures including soft panels and hinges.

INTRODUCTION

Currently available children's play structures are generally sold as "one size fits all." Effectively, such play structures are of a fixed size and orientation. These play structures offer very little in the way of customization. Such structures become boring to children and a burden to families once they are not played with, especially in light of the difficult installation and substantial investment.

Traditional play structures for children are often a rigid structure, either made of wood or metal, coupled with one or more swings and slides. Frequently, such play structure kits include an assortment of hardware and are often very difficult to assemble. Once assembled, depending on the size of the structure, they can be very difficult to move or dispose of once the child has outgrown the structure.

As currently play structures usually consist of heavy rigid walls and fixed connections, they are not easily modified or updated for extended use. Typical play structures also target one specific age range and play pattern, which must be determined by the consumer at the time of purchase. Essentially, when purchasing traditional play structures, a parent must attempt to predict the play style of their child years in advance.

It would be desirable to have apparatuses and methods for play structures of variable size and configuration.

Thus, it would be desirable to have apparatuses and methods for play structures that are easily assembled and relocated. Further, it would be desirable to have play structures that are adaptable with the changing play style of growing children.

Additionally, it would be desirable to provide play structures that can easily collapse, be moved, and/or stored.

SUMMARY

The invention of the present disclosure may be a temporary structure comprising a junction assembly. The junction assembly may include a hub, where the hub is an annular member having a plurality of hub walls; a plurality of hinges, each of the plurality of hinges disposed on each of the plurality of hub walls; and/or a plurality of brackets, each of the brackets swivably attached to each of the plurality of hinges, each of the brackets having at least one bracket loop, a first tine, a second tine, and a top wall. The temporary structure may further comprise a plurality of posts, each of the plurality of posts having a post top end and a post bottom end; a plurality of feet, each of the plurality of feet comprising a foot column and a base, where each of the plurality of feet are sized to accept the post bottom end and each of the plurality of brackets are sized to accept the post top end; and/or a plurality of panels, each of the plurality of panels sized to traverse one or more of the plurality of posts.

DETAILED DESCRIPTION

Figure 1:
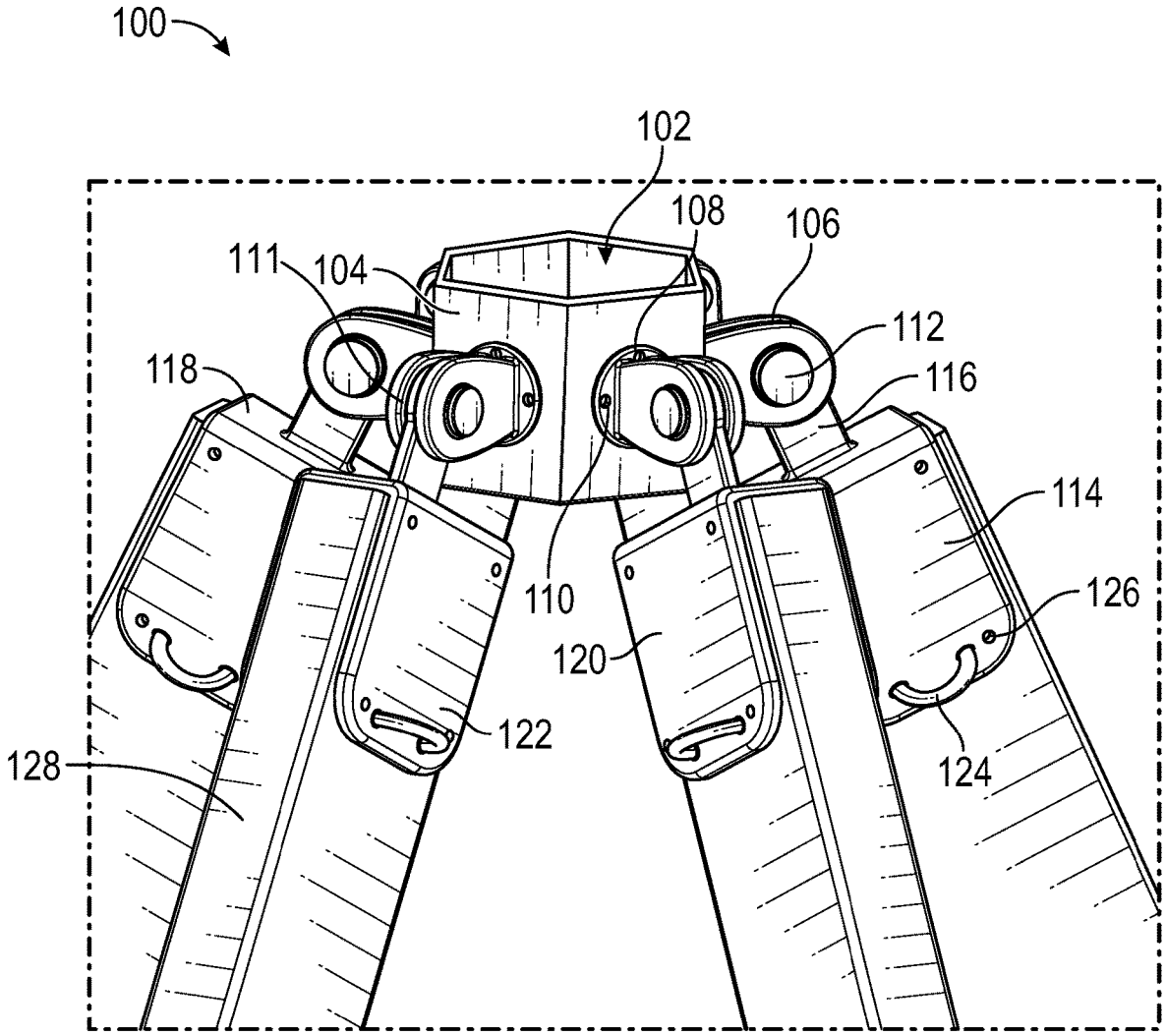
FIG. 1 is an illustration of an embodiment of a junction assembly.

The present invention adds a whole new dimension to temporary structures, specifically those configured as play structures.

Throughout the specification, wherever practicable, like structures will be identified by like reference numbers. In some figures, components, such as additional electrical connections or fasteners have been omitted for clarity in the drawings. Unless expressly stated otherwise, the term "or" means "either or both" such that "A or B" includes A alone, B alone, and both A and B together.

The invention of the present disclosure may be an apparatus for facilitating customizable structures for children and parents by using different panels to build unique play spaces. The set may include brackets, panels, rope, and/or wood, among other options. In an embodiment, the structure may utilize several different soft panels to design a different aesthetic and function on each 'wall'. Accordingly, panels may be switched to update or expand the child's play. In a further embodiment, structures may be connected together to create nearly infinite designs. The structure may be disassembled to a size enabling a user to compactly store or even mail the structure components to a friend.

The panels may be used in a variety of ways and the user may customize their structure by choosing exactly which panels fit their needs. The user may constantly upgrade and rework their structure to change the play pattern as needed or as the children grow. In an embodiment, the structure's design is easy to assemble by using only straight cuts with standard and consistent size wood screws. Further, because the structure may utilize soft panels, it may be easy to attach and remove the panels from the main structure. Moreover, the panels may be sufficiently soft and pliable, such that they may be compactly stored when not in use (for example, folded). The panels may be composed of a UV resistant outdoor material. Further, the panels may be composed of a permeable or semi-permeable material, such that rain and wind may pass through the panels. In an embodiment, the structure is configured to utilize standard size lumber, for example 2×4 or 4×4, having standard construction wood lengths (for example, 8' to 12' long) and without angular cuts.

In an embodiment, the set may include a variety of soft panels that will adapt to different sizes depending on the chosen structure height. Accordingly, as the child grows, the user may expand the original panels to fit a different height. Each panel may serve a specific function and may be fastened to the structure using simple rope ties, hook and loop fasteners, snaps, and/or buckles (for example, so they may be quickly and easily swapped out as needed). The set may also include ground stakes to secure the structure into the ground. Thus, the user may position weight on different sides and group additional structures together to create larger modular structures.

Referring to FIG. 1, the invention of the present disclosure includes a junction assembly 100. The junction assembly 100 may include a hub 102, where the hub 102 further includes a plurality of hub walls 104. The hub 102 may be an annular member having a plurality of hub walls 104, where the walls 104 are flat or partially flat. For example, the hub 102 may be an annular multi-sided member. However, the hub 102 may include a singular outer surface and/or a singular inner surface. Accordingly, in such an embodiment, the hub 102 may include no flat hub walls 104, like those shown in FIG. 1. In one embodiment, as represented by FIG. 1, the hub 102 may be a hexagonal angular member. However, the hub 102 may be any suitable shape or dimensions. As non-limiting examples, the hub 102 may include three walls 104, four walls 104, five walls 104, six walls 104, seven walls 104, or eight walls 104. However, the hub 102 may include any suitable number of walls 104. The walls 104 may be arranged such that each wall 104 has the same dimensions. For example, each wall 104 may have the same length, width, depth, and may be positioned at the same angle to adjacent walls 104. The hub 102 may have a central void, for example, as pictured in FIG. 1, and in other semi-hollow annular embodiments. However, the hub 102 may also not include a void (for example, in a solid embodiment).

Each hub wall 102 may include a corresponding hinge 106. Alternatively, any number of hub walls 104 may have a corresponding hinge 106. For example, every other hub wall 104 may include a hinge 106. Each hinge 106 may include a hinge mount 108, one or more hinge mount holes 110, and a hinge pin 112. The hinge mount 108 may be disposed flush upon a hub wall 104. For example, the hinge mount 108 may be disc-like, having a flat surface sized to interface with a hub wall 104. The hinge mount 108 may include one or more hinge mount holes 110 configured to accept a fastener (for example, a screw, nail, pin, or other suitable fastener). In such an embodiment, the hub wall 104 may include a number and arrangement of hinge mount accepting holes (not shown), configured to accept a fastener, such that the hinge mount 108 and hinge 106 may be suitably attached to the hub wall 104. In one embodiment, each of the one or more hinge mount holes 110 may be equidistant from an adjacent hinge mount hole 110. The hinge 106 may further include a hinge attachment member 111. The attachment member 111 may be one or more tines, each tine having an opening, where a hinge pin 112 may be disposed through both openings. The attachment member 111 may be welded to the hinge mount 108. Alternatively, the attachment member 111 and hinge mount 108 may be a singular piece of material (for example, forged or milled).

Each hinge 106 may have a corresponding bracket 114. A bracket 114 may include a bracket stem 116, a top wall 118, a first tine 120, a second tine 122, a bracket loop 124, and/or one or more bracket holes 126. The bracket stem 116 may be configured to accept a hinge pin 112 and/or to be accepted by the hinge 106 (for example, via the hinge attachment member 111). The hinge 106 and the bracket 114 and/or bracket stem 116 may be movably attached. For example, the hinge 106 may be fixed to the hub 102, enabling the bracket 114 to revolve around the hinge 106. In an embodiment, the bracket 114 may have roughly 180 degrees of motion about the hinge 106 (for example, configured to move in the y-axis). However, in alternate embodiments, the bracket 114 may have any suitable range of motion about the hinge 106. In an embodiment, the range of motion is approximately 180 degrees. Bushings or washers may be disposed between the bracket 114 and the hinge 106. In such an embodiment, the bushings or washers may apply friction between the bracket 114 and the hinge 106, such that the bracket 114 requires an elevated degree of force to move. For example, a rubber (or other suitable material) element may be utilized to prevent the bracket 114 from swinging too quickly or with too little force. In a further embodiment, the hinge 106 includes a locking mechanism, allowing the bracket 114 to be locked at a desired angle. Once a desired angle has been achieved, the hinge pin 112 may be tightened such that the posts 128 may not easily move. For example, the hinge 106 may be tightened when the posts 128 are in a closed position, to prevent the posts 128 from hitting into other posts 128. Further, the hinge 106 may be tightened when the posts 128 are in an open position, to prevent the structure from collapsing. However, in an alternate embodiment, any suitable component of the hinge 106 or bracket 114 may be tightened to retard movement of the posts 128. For example, a bolt or screw may be disposed on the hinge 106 and/or bracket 114, wherein tightening the bolt or screw, increases friction and decreases potential movement. In an embodiment, the hinge pin 112 is threaded. Further, the bracket 114 and/or hinge 106 may be threaded to accept the hinge pin 112.

The bracket 114 may include a top wall 118, where the bracket stem 116 extends orthogonally from the top wall 118. The bracket stem 116 may be a generally rectangular thin member. However, the bracket stem 116 may have a disc-shaped end portion. The disc-shaped end portion may be configured to increase the surface area contact with the hinge attachment member 111. The end portion of the bracket stem 116 may include a hole configured to accept the hinge pin 112. However, in another embodiment, the hinge pin 112 may be integral to or fused to the bracket stem 116. For example, the hinge pin 112 may be cylindrical members disposed on each side of the end of the bracket stem 116, such that the cylindrical members extend through the hinge attachment member 111 holes.

Each side of the bracket 116 may include a tine, for example, a first tine 120 and a second tine 122. In an alternate embodiment, the bracket 116 includes a third and/or fourth tine. Alternatively, the bracket 114 may include a sleeve sized to accept a post 128. The top wall 118, the first tine 120, and the second tine 122, may be configured and sized to accept a post 128, for example, a post top end 130. The post 128 may be any standard piece of lumber. For example, an 8, 10, or 12 foot 2×4. Accordingly, the bracket 116 may be roughly 3.5 inches wide with a gap between the first tine 120 and second tine 122 of 1.5 inches. However, the gap may be sized to accept any common lumber dimension. In an embodiment, the first or second tine 120/122 may have a rounded bottom portion (for example, to reduce sharp corners or edges). Thus, any of the components of the structure may include rounded edges as a means of increasing the safety to children users and adult assemblers.

The first tine 120 and/or the second tine 122 may include a bracket loop 124 and one or more bracket holes 126. The bracket loop 124 may be a semi-circular member or any other semi-annular member disposed on the surface of the first tine 120 and/or second tine 122. The bracket loop 124 may be configured to accept a latch, key ring, or other fastener mechanism. The bracket holes 126 may be sized to accept standard fasteners (for example, a wood screw). In an embodiment, the post top end 130 may include corresponding holes configured to accept standard fasteners via the bracket holes 126. In an embodiment, the tines 120/122 may have four bracket holes 126, each bracket hole occupying a different corner of each tine 120/122. In one embodiment, the bracket loop 124 may be disposed on the bottom of the tine 120/122 and/or may reside between two bracket holes 126. In a further embodiment, one or more bracket holes 126 may be disposed on the top wall 118. The one or bracket holes 126 of the first tine 120 and those of the second tine 122 may be skewed to prevent fasteners from colliding from opposite sides of the bracket 116.

The post 128 may be any standard piece of lumber. Alternatively, the post 128 may be any member sufficiently sturdy to support the weight of the apparatus. For example, in alternate embodiments, the post 128 may be PVC pipe, copper pipe, carbon fiber, polymer, or any other suitable material.

The invention of the present disclosure may also include a foot 200. The foot 200 may include a foot column 202. The foot column 202 may be a partially hollow member configured and sized to accept the post 128, for example the post bottom end 132. The foot column 202 may include an inner column wall 204, an outer column wall 206, and/or one or more side column walls 208. The bottom of the foot 200 may be a base 212. The base 212 may be sufficiently flat, as to support at least the foot 200 and the attached post 128. In an embodiment, the bottom surface of the inside of the foot column 202 is an angled flat portion configured to accept the post bottom end 132. For example, the angled flat portion may be angled such that the base 212 may be parallel to the ground when the corresponding post 128 is in an assembled position.

An acute angle may be formed between the inner column wall 204 and the base 212. Accordingly, an obtuse angle may be formed between the outer column wall 206 and the base 212. In an embodiment, the angle formed by the inner column wall 204 and the base 212 and the angle formed by the outer column wall 206 and the base 212 may be supplementary. However, the aforementioned angles may be any suitable angle. In an embodiment, the base 212 may be triangular. In such an embodiment, the triangular base may be oriented to include two stake holes 214 on the inside corners and one stake hole 214 on the outside corner. Accordingly, the base 212 may be oriented to provide increased anchoring potential on the inside portion (the portion closer to the center of the structure), to better support the structure. However, in another embodiment, the stake holes 214 may be disposed on any portion of the base 212 and/or the base 212 may be any suitable shape.

The foot 200 may include a foot loop 210 disposed on at least one of the side column walls 208. However, the foot may include any number and/or combination of foot loops 210. The foot loop 210 may be disposed such that the horizontal plane of the foot loop 210 is parallel to the base 212. In a further embodiment, a foot loop 210 may be disposed on the inner column wall 204 and/or the outer column wall 206. In various embodiments, the foot loop 210 may be disposed at any angle and orientation. In one embodiment, the foot loop 210 may be disposed on at least one of the side column walls 208, such that the plane of the foot loop 210 is parallel to the post 128. However, the foot loop 210 may be disposed parallel to the bottom surface of the post 128.

The base may include one or more stake holes 214. The stake holes 214 may be sized to accept a stake or other means of fastening the foot 200 to the ground (for example, a grassy yard). In one embodiment, the stake holes 214 are located at each corner of the base 212. In a further embodiment, the foot 200 may include a drainage hole within the foot column 202. The drainage hole may be positioned at the lowest portion of the angled flat portion on the bottom surface of the inside of the foot column 202. The drainage hole may allow for fluid communication between the inside of the foot column 202 and the environment beneath the base 212. Such a drainage hole may be configured to remove rainwater that runs down the post 128 into the foot column 202. The drainage hole may aid in reducing wood rot and increasing long term structural integrity.

Figure 3:
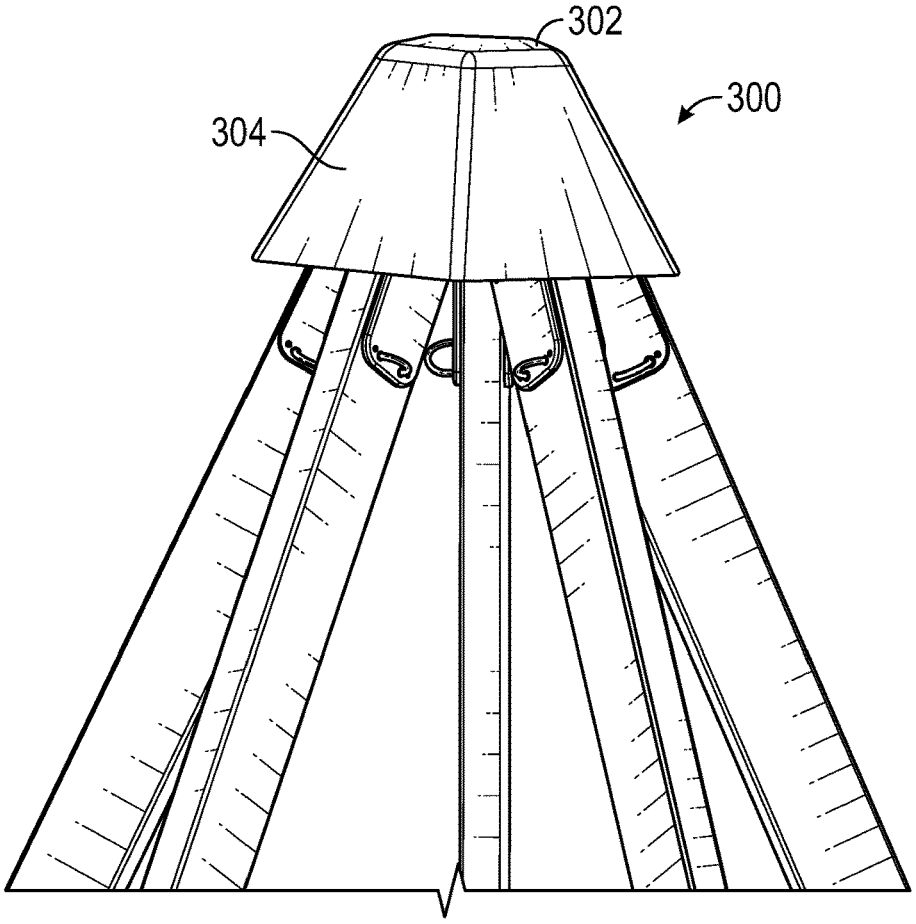
FIG. 3 is an illustration of an embodiment of the structure, including a cap.

Referring to FIG. 3, the invention of the present disclosure may include a cap 300. The cap may further include a cap top 302 and a plurality of cap walls 304. The cap top 302 may be sufficiently flat such that the inside surface of the cap top 302 interfaces with the top surface of the hub 102. Each of the cap walls 304 may be configured such that the walls 304 are parallel to the outward facing surface of the corresponding post 128. For example, the cap 300 may be sized and configured to sit flush with the junction assembly 100. In an embodiment, the cap 300 and, specifically, the cap walls 304, are angled as to prevent the hinges 106 from rotating past the plane of the cap walls 304. For example, the cap walls 304 may physically block the movement of the hinge 106 past a pre-determined angle. Each cap wall 304 may therefore be parallel to the desired angle of the corresponding post 128. Accordingly, the cap 300 may include at least as many walls 304 as there are posts 128. However, in an alternate embodiment, the cap 300 includes a single outer surface, for example a rounded surface akin to a dome. In another embodiment, the structure may not include a cap 300.

In an embodiment, the inside surface of the cap 300 includes ribbing to increase structural integrity. The cap 300 may be configured to "snap" onto the junction assembly 100 (for example, to the top portion of the hub 102). Accordingly, the inside surface of the cap 300 may include an attachment mechanism sized to accept a suitable portion of the junction assembly 100. Conversely, the junction assembly 100 may include an attachment mechanism configured to accept a suitable portion of the inside surface of the cap 300. In another embodiment, the cap 300 includes magnets configured to maintain the cap's position on the metal hub 102.

Figure 4A:
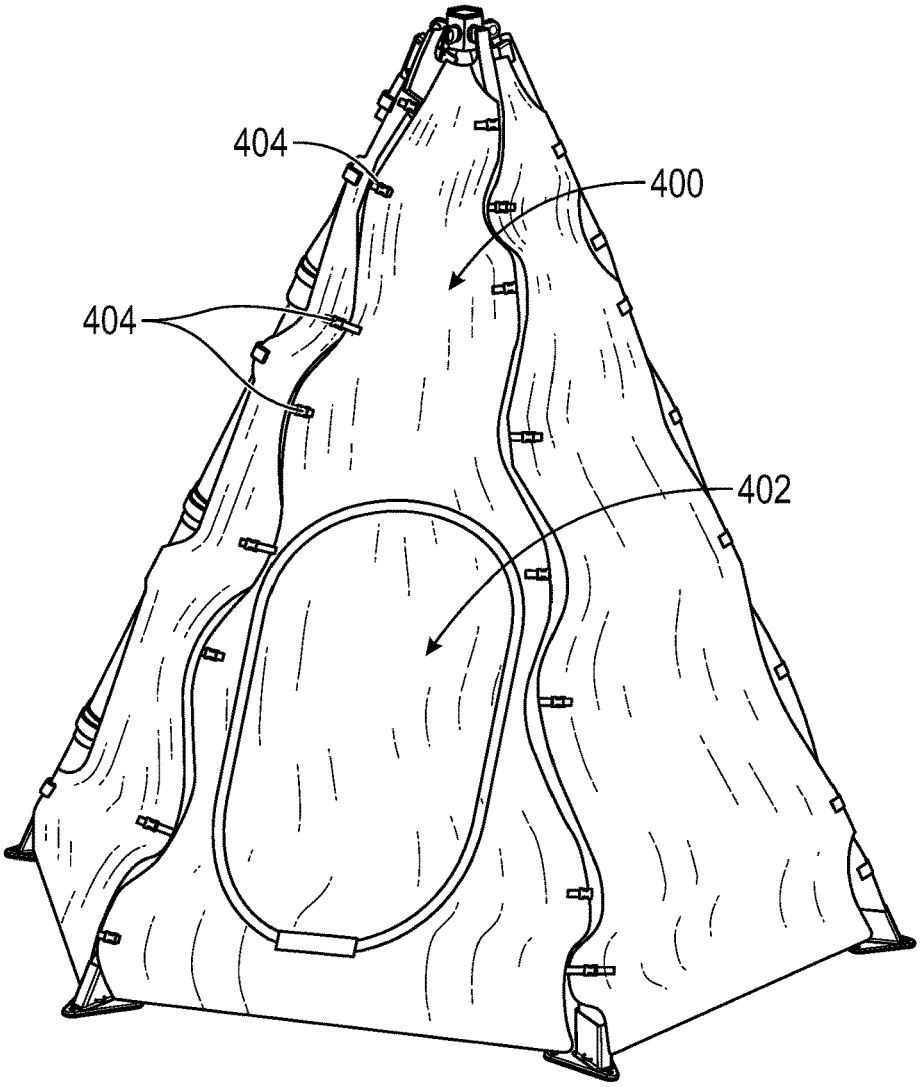
FIG. 4A is an illustration of an embodiment of the temporary structure, including a plurality of panels.

Referring to FIG. 4A, the invention of the present disclosure may include one or more panels 400. Each panel 400 may be sized to traverse two adjacent posts 128. However, in alternate embodiments, a panel 400 may be sized to traverse any number of posts 128. The panel 400 may traverse two adjacent posts 128, the junction assembly 100 (for example, partially covering the junction assembly 100), and the ground. The panel 400 may include a panel feature 402. The panel feature 402 may be a zipper doorway, climbing rope net, or any other suitable feature.

Figure 4B:
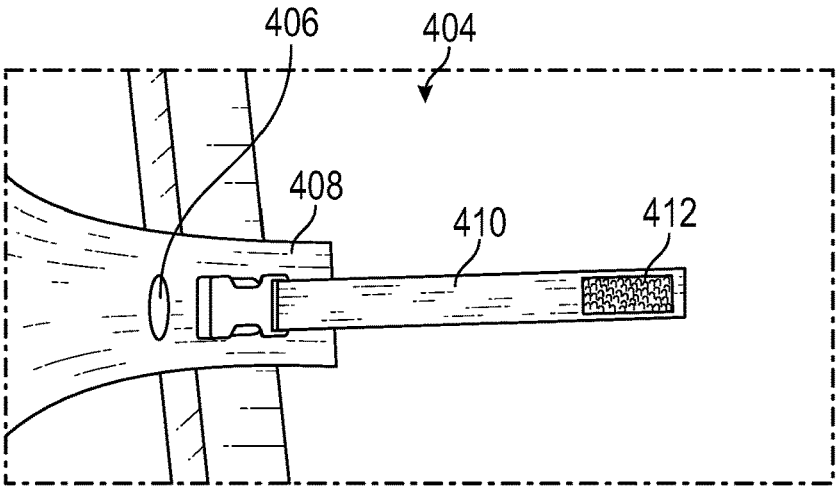
FIG. 4B is an illustration of an embodiment of a panel fastener.

Referring to FIG. 4B, each panel 400 may include a plurality of attachment members 404. In an embodiment, the attachment members 404 may be disposed on the outside perimeter of the panel 400 and may extend outward. Each attachment member 404 may comprise an opening 406, a buckle 408, a strap 410, and/or a fastener 412. In an embodiment, the attachment member 404 may be utilized to reversibly attach the panel 400 to a post 128 or another panel 400. The strap 410, having the fastener 412 disposed at the strap 410 end, may be threaded through the opening 406, where the fastener 412 may be engaged (for example, a hook and loop fastener). The strap 410 may be reversibly connected to the panel 400 via the buckle 408. One portion of the buckle 408 may be disposed on the panel 400, while the other portion of the buckle 408 may remain disposed on the strap 410.

Accordingly, a user may attach a panel 400 to a post 128 by placing an attachment member 404 in proximity to a post 128, wrapping the strap 410 around the post 128, through the opening 406, and engaging the fastener 412. In an embodiment, the strap 410 may include a fastener 412 on each side of the strap 410.

In an embodiment, the attachment member 404 may be configured to interface with a receiving member on a post 128, another panel 400, or another component of the structure. For example, a panel 400 may comprise receiving members, for example, the "hook" of a hook and loop fastener, while another panel 400 may have a fastener 412, wherein the fastener 412 is the "loop" of a hook and loop fastener. Thus, the attachment member 404 and receiving member may be complimentary fastener components disposed on adjacent panels 400. In such an embodiment, each panel 400 may include both attachment members 404 and receiving members.

In an embodiment, the attachment member 404 may include one or more fasteners 412 and a strap 410. In such an embodiment, the attachment member may include a proximal end, for example, initially thread through the opening 406 of a host panel (the host panel being the panel comprising said attachment member 404). A fastener 412 may be disposed on both the proximal and distal ends of the attachment member 404. For example, the proximal end may include the 'hook' portion and the distal end may include the 'loop' portion of a hook and loop fastener. The proximal end of the strap 410 may be thread through the host opening 406 and may be sewn to a near-proximal end portion of the strap 410. For example, roughly three inches of the strap 410 may be fed into the host opening 406, turned 180 degrees, and attached to the nearest proximal end portion of the strap 410. Such an embodiment may create a loop in the strap 410 at the proximal end. Accordingly, the strap 410 may be attached to the host panel 400 via the sewn proximal end and/or loop. Further, to attach the host panel 400 to an adjacent panel 400 or post 128, the distal end of the strap 410 may be thread through an adjacent opening 406 (to attach the host panel 400 to the adjacent panel 400) or may be thread around the post 128 (to attach the host panel 400 to the post 128). Next, the distal end of the attachment member 404 or strap 410 may be thread through the host opening 406 to fasten the distal end fastener to the proximal end fastener, thus mating the panel 400 to another panel 400 or to the post 128.

Figure 5:
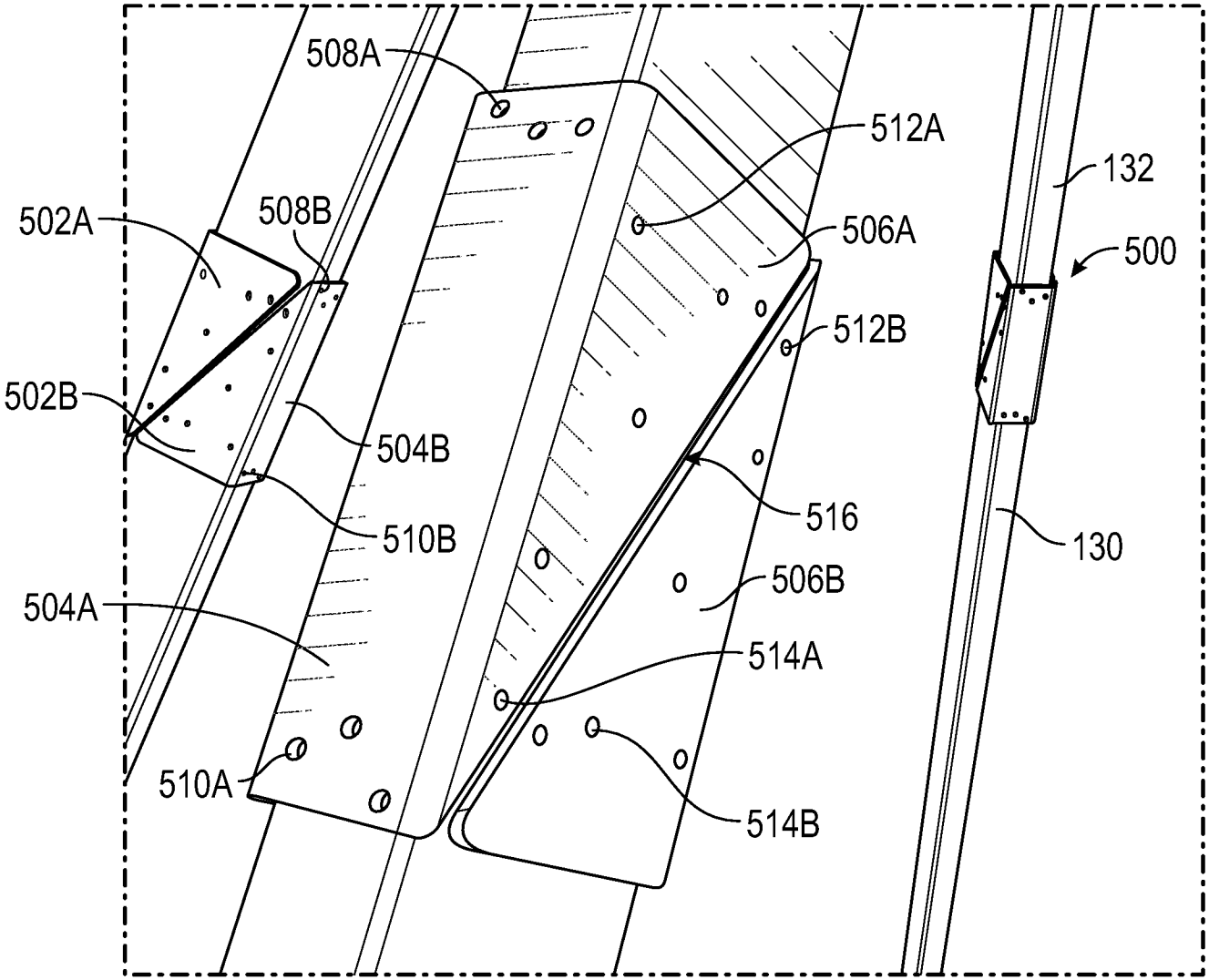
FIG. 5 is an illustration of an embodiment of a connector, having a first connector member and a second connector member.

Referring to FIG. 5, the invention of the present disclosure may include a connector 500 composed of one or more connector members, for example, a first connector member 502*a* and a second connector member 502*b*. In an embodiment, the connector 500 may be composed of any suitable material, for example, steel. The connector 500 may be configured to join two or more posts 128. For example, the connector 500 may accept a post bottom end 132 and a post top end 130.

In an embodiment, the first connector member 502*a* and/or the second connector member 502*b* partially surround two posts 128. For example, each connector member 502*a*/502*b* may interface with at least three sides of a post 128. The first connector member 502*a* may include a first connector outer wall 504*a* and one or more first connector side walls 506*a*. The first connector outer wall 504*a* may be rectangular and may be disposed on the outer side (for example, facing away from the center of the structure) of the one or more posts 128. The first connector side walls 506*a* may be triangular and may interface with the sides of the one or more posts 128. The first connector side walls 506*a* may be right triangles where the opposite leg of the triangle is disposed over an upper post 128 and the vertex formed by the hypotenuse and the adjacent leg is disposed over a lower post 128. For the purposes of this disclosure, an upper post may be a post 128 disposed between a bracket 114 and a connector 500 and a lower post may be a post 128 disposed between a connector 500 and a foot 200.

The one or more first connector outer top holes 508*a*, the one or more first connector outer bottom holes 510*a*, the one or more first connector side top holes 512*a*, and the one or more first connector side bottom holes 514*a* may be sized and configured to accept any standard fastening instrument, for example, a wood screw, bolt, nail, or pin. The first connector outer top holes 508*a* and the first connector side top holes 512*a* may be utilized to fasten the first connector 502*a* to an upper post 128. The first connector outer bottom holes 510*a* and the first connector side bottom holes 514*a* may be utilized to fasten the first connector 502*a* to a lower post 128.

The second connector member 502*b* may include a second connector inner wall 504*b* and one or more second connector side walls 506*b*. The second connector inner wall 504*b* may be rectangular and may be disposed on the inner side of the one or more posts 128. The second connector sides walls 506*b* may be triangular and may interface with the sides of the one or more posts 128. The second connector side walls 506*b* may be right triangles where the opposite leg of the triangle is disposed over a lower post 128 and the vertex formed by the hypotenuse and the adjacent leg is disposed over an upper post 128.

The one or more second connector inner top holes 508*b*, the one or more second connector inner bottom holes 510*b*, the one or more second connector side top holes 512*b*, and the one or more second connector side bottoms holes 514*b* may be sized and configured to accept any standard fastening instrument, for example, a wood screw, bolt, nail, or pin. The second connector inner top holes 508*b* and the second connector side top holes 512*b* may be utilized to fasten the second connector 502*b* to an upper post 128. The second connector inner bottom holes 510*b* and the second connector side bottom holes 514*b* may be utilized to fasten the second connector 502*b* to a lower post 128.

The first connector side wall 506*a* and the second connector side wall 506*b* may be sized such that when the two sides interface, they generally form a rectangle (for example, from both triangular sides). The side walls 506*a*/506*b* may be sized such that a connector clearance 516 exists between the first connector member 502*a* and the second connector member 502*b*. For example, the connector clearance 516 may be a gap between the connector members 502*a*/502*b*. Such a connector clearance 516 may assure that if the lumber is not of ideal dimensions, the first connector outer wall 504*a* and the second connector inner wall 504*b* may sufficiently interface (for example, in a flat manner) with the inner and outer sides of the post 128.

A post joining line (not shown) may be present at the meeting point of the upper and lower post. The post joining line may be disposed at the vertical midpoint of the connector 500.

In an embodiment, the holes 508*a*/508*b*/510*a*/510*b*/512*a*/512*b*/514*a*/514*b* may be arranged such that the insertion of a fastener (for example, a screw) would not interfere with a fastener inserted from the opposing connector side wall. For example, the aforementioned holes may be arranged such that one fastener does not interfere with another fastener.

Figure 6:
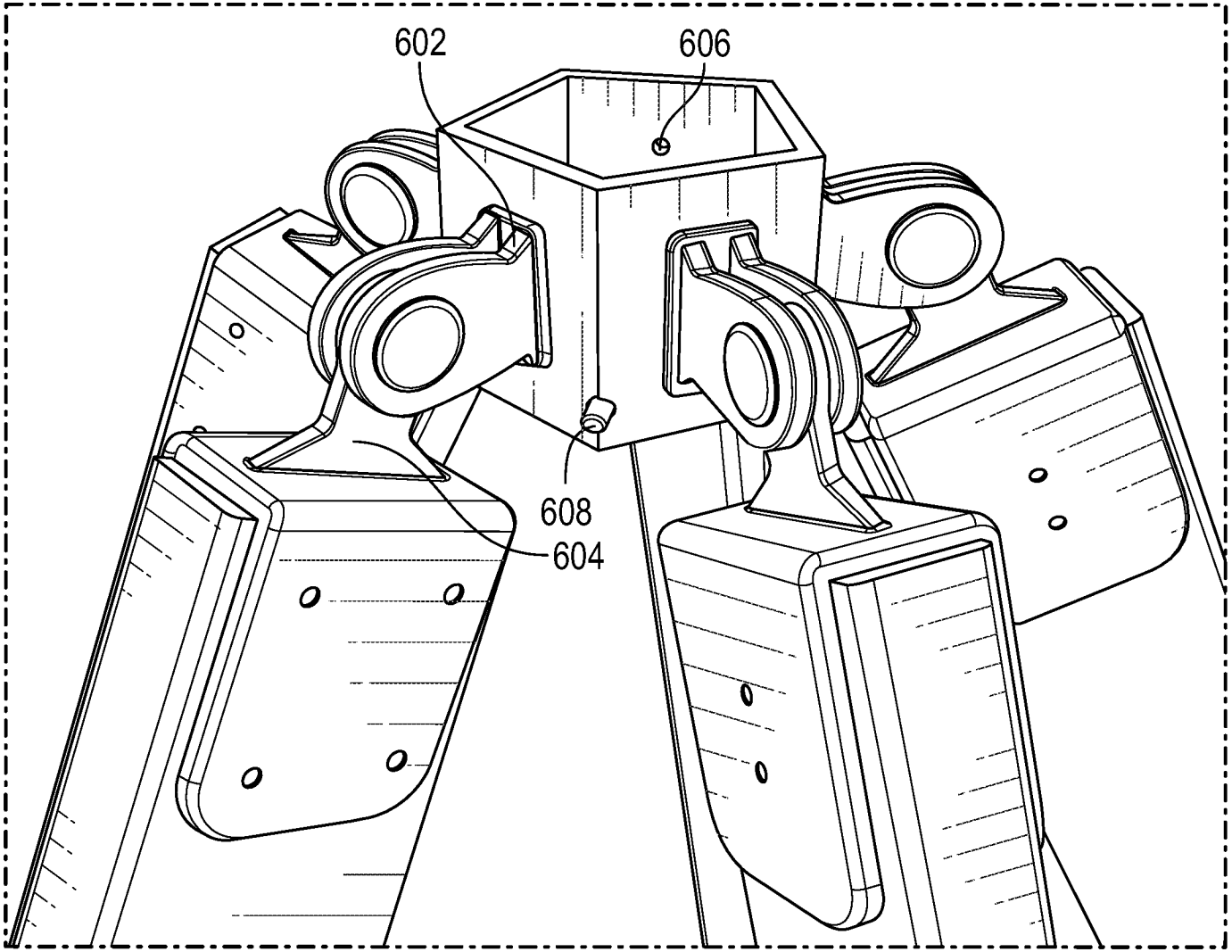
FIG. 6 is an illustration of another embodiment of a junction assembly, the hinge having a hinge tail.

FIG. 6 illustrates a further embodiment of the junction assembly 100, where the hinge 106 includes a hinge tail 602. The hinge tail 602 may be a member connecting the hinge 106 to the hub 102 (for example, via a hinge mount 108). The hinge tail 602 may be flared to increase support. For example, from the outer portion of the hinge 106 to the inner portion of the hinge 106, the hinge 106 may vertically narrow and then, along the hinge tail 602, vertically broaden as the hinge 106 contacts the hub 102. The bracket stem 116 may further include a bracket stem tail 604. The bracket stem tail 604 may be a flared portion of the bracket stem 116. The bracket stem tail 604 may be flared lengthwise, for example, in the plane of motion of the hinge 106. Accordingly, the flared bracket stem tail 604 may increase rigidity and structural integrity of the bracket stem 116 by increasing the surface area in which the tail 604 interfaces with the top wall 118 of the bracket 114.

Additionally, referring to FIG. 6, the bracket holes 126 of the first tine 120 and the second tine 122 may be configured, such that the holes 126 of each tine 120/122 do not align. For example, the first tine 120 may have two bracket holes 126 disposed relatively central to the first tine 120. In such an example, the second tine 122 may have four bracket holes 126 disposed at each corner of the second tine 122. Thus, fasteners may not interfere as they are entered into the bracket holes 126 from opposites tines 120/122.

Further, referring to FIG. 6, the junction assembly 100 may include one or more anchor holes 606 and one or more anchor bolts 608. The anchor holes 606 may be sized to accept the anchor bolts 608. In another embodiment, one anchor bolt 608 may traverse one or more (for example, two) anchor holes 606. The anchor bolt 608 may be configured to support the weight of a hanging apparatus (for example, a swing or hanging seat). In an embodiment, the anchor bolt 608 and/or anchor hole 606 may be threaded (for example, complimentarily threaded). In a further embodiment, the anchor bolt 608 is secured by an anchor nut (not pictured) or retaining pin (for example, a cotter pin).

Figure 2:
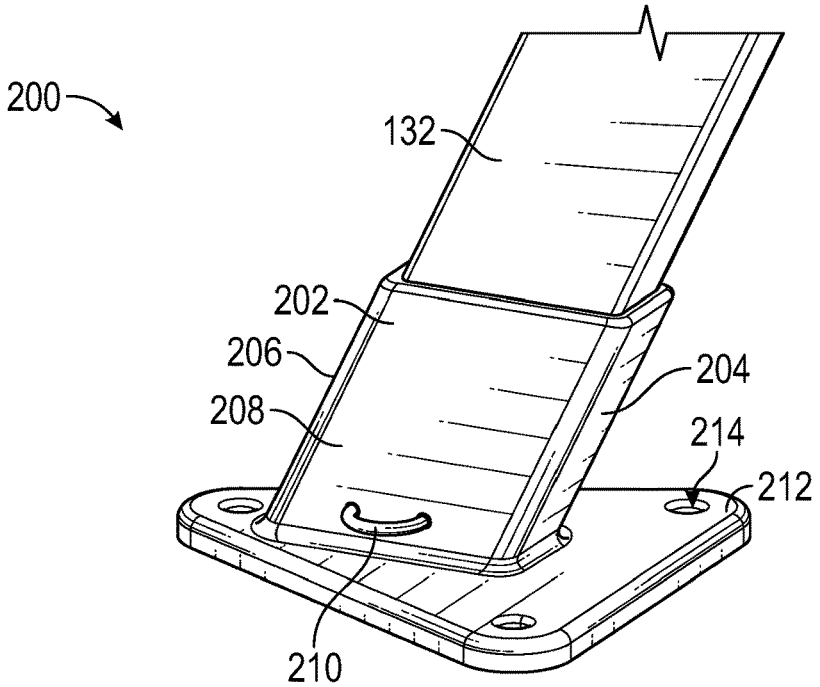
FIG. 2 is an illustration of an embodiment of a foot.
Figure 7:
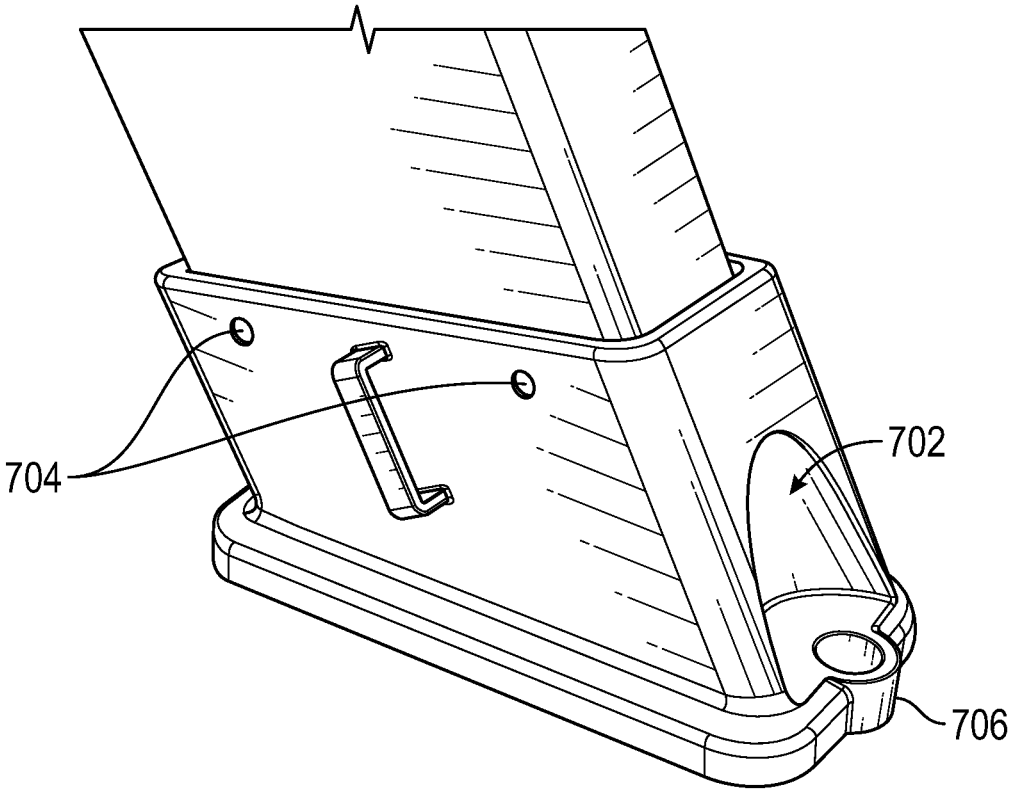
FIG. 7 is an illustration of another embodiment of a foot, the foot having a niche.

FIG. 7 depicts a further embodiment of the foot. In such an embodiment, the base 212 may be smaller than that of FIG. 2. The foot column 202 may have a niche 702 disposed along the base 212 and the outer column wall 206. The niche 702 may be a voided portion of the foot column 202. For example, the niche 702 may be sized to both allow a user to easily insert a stake into the stake hole 214 and to reduce the required footprint of the base 212. Further, the foot 200 may include one or more column holes 704 disposed on the column side wall (or any other wall of the column). The column holes 704 may be configured to accept a standard fastener, enabling the foot to be attached to a post 128. Referring to FIG. 7, the foot loop may be disposed at the same angle as the post 128 and/or panel 400 (not pictured). Further, the base may include a base protrusion 706. The base protrusion 706 may partially surround the stake hole. Such an embodiment, for example, a base with the base protrusion 706, may be configured to both provide a structurally sound stake hole and a minimal footprint base.

Figure 8A:
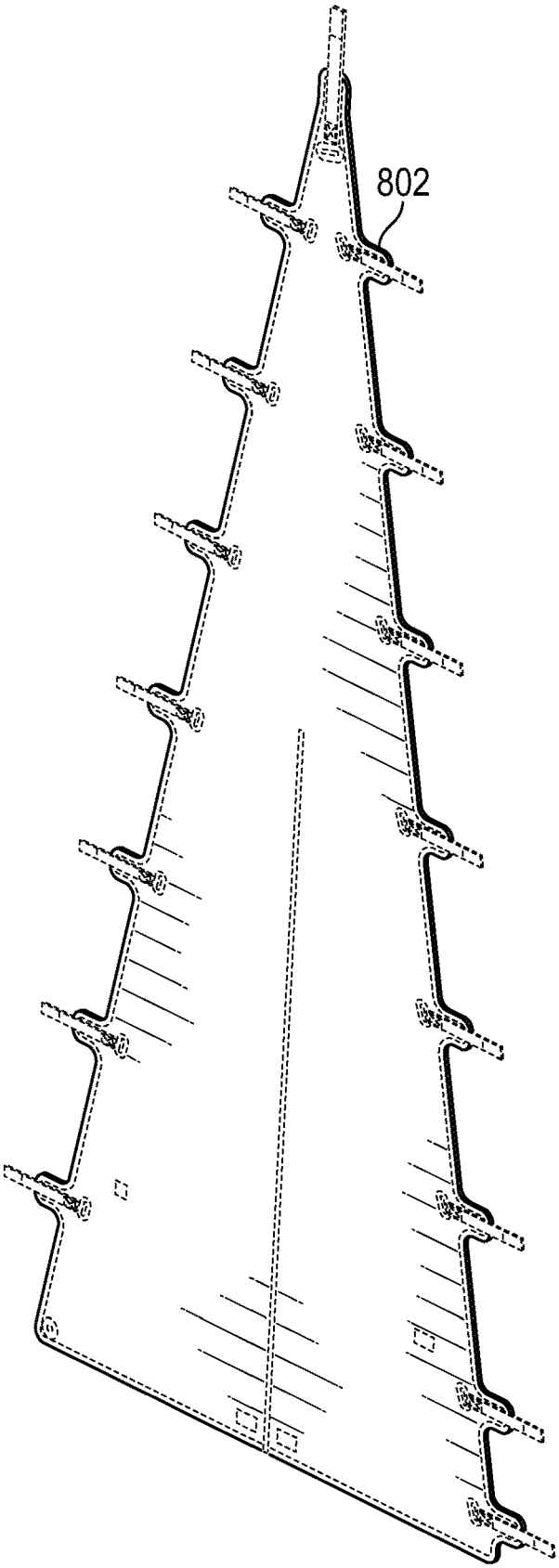
FIGS. 8A-8B is an illustration of embodiments of panels.

Referring to FIG. 8A, the panel may include a door configured as a slit in the panel wall. In an embodiment, the panel may be composed of a material configured to promote airflow. For example, the panel material may be suitably porous, such that wind may more easily travel through the panel. Accordingly, as the panels may not catch substantial wind, the structure as a whole may be more secure and less inclined to topple.

Figure 8B:
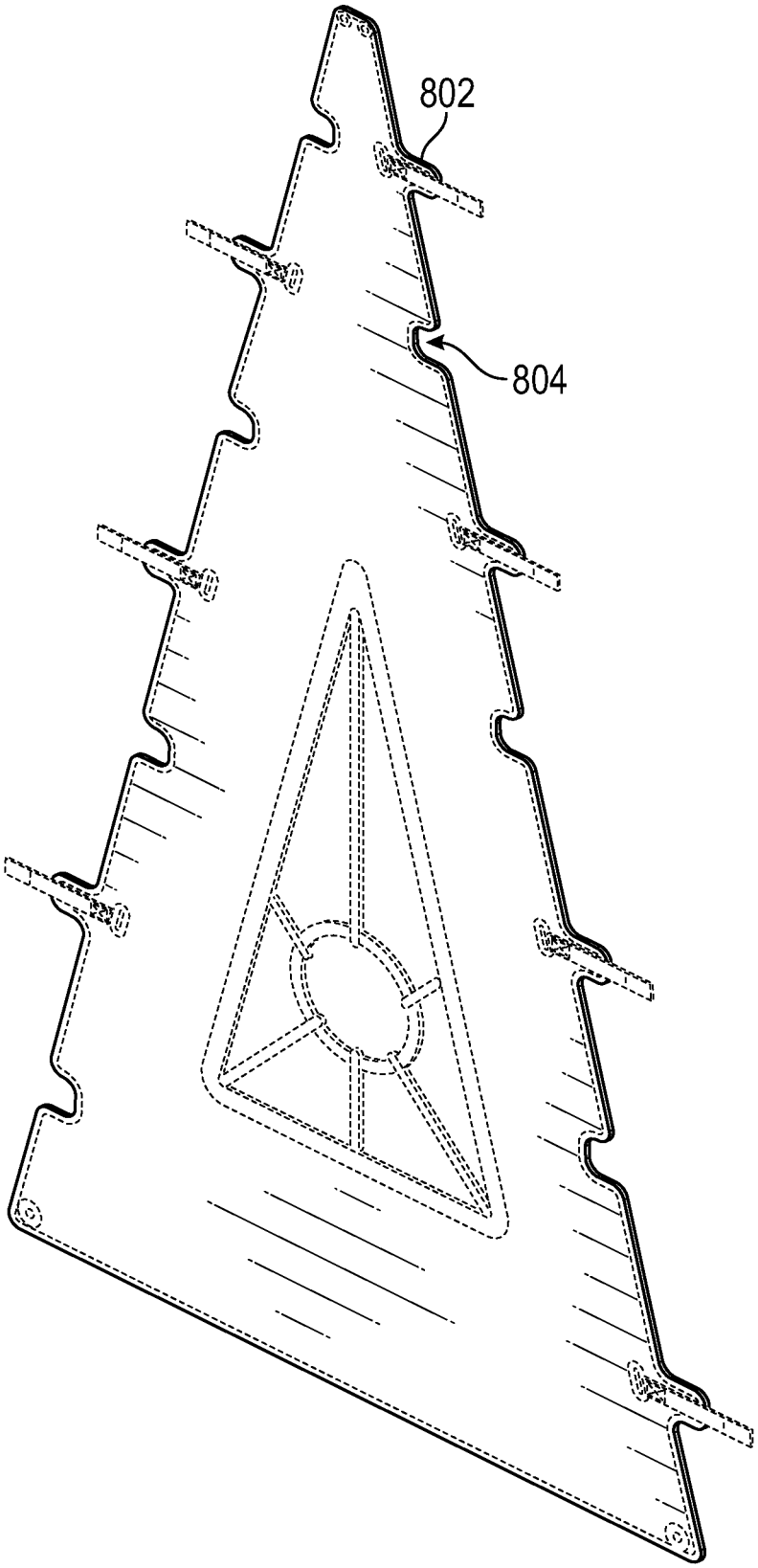

Referring to FIG. 8B, the panel may include a climbing net disposed at the center of the panel wall. The panel may include a number of tabs 802 disposed around the perimeter of the panel. Each tab may house one or more fasteners or straps. Additionally, each panel may include one or more recesses 804. The recesses 804 may be sized to accept the tabs 802. As a non-limiting example, the tabs 802 and recesses 804 may be configured such that, when adjacent panels are attached, a tab 802 may enter a recess 804. Accordingly, the panels may be attached via the fasteners, such that the tabs 802 and recesses 804 join, creating a seamless surface to the structure.

Each panel may include alternating hook and loop straps that wrap around the post 128 and also through a receiving side of the next panel. Thus, the straps 410 and/or attachment members 404 may be permanently affixed through their respective openings 406. However, in another embodiment, the straps 410 and/or attachment members 404 are removable.

In an embodiment, the panel may lack tabs or recesses. In such an embodiment, the panel may include a plurality of openings 406 around the perimeter of the panel. For example, the openings 406 may populate the left and right sides of the panel. The openings 406 may be surrounded by a grommet. The openings 406 of each side may be equidistant from one another. In an embodiment, an opening 406, ring, or other attachment point may be disposed atop the apex of the panel. In an embodiment, the attachment members 404 and/or straps 410 may be disposed upon every other opening 406. Further, the attachment members 404 and/or straps 410 may appear on opposite alternating openings 406 on the right side of the panel as opposed to the left side of the panel. For example, beginning at the bottom of the panel, a strap 410 may be disposed on the first, third, and fifth openings 406 of the left side and the second, fourth, and sixth openings 406 of the right side. Accordingly, two panels in such a configuration may attach to one another via the staggered straps 410 and openings 406.

In an embodiment, any number or combination of panels may be used. Thus, the structure as a whole is highly customizable, as the user may select which panels to affix to the structure. In another embodiment, the panels may be composed of wood, rope, metal, polycarbonate, or plastic. In an embodiment, the panels are compose of a UV resistant outdoor material, which may be weather-proof.

The panels may be affixed to the structure via rope. For example, each panel may include one or more grommets, enabling the user tie the panel to the post, bracket (for example, bracket loop), or foot (for example, foot loop) by threading a rope through the grommet and corresponding hole (for example, bracket loop or foot loop).

The invention of the present disclosure may be utilized for commercial use, to build shelter systems in disaster zones, or for recreational use. In embodiments where the structure is utilized for shelter use, the panels may be secured tightly by applying additional straps and/or fasteners.

In an embodiment, when the structure is deconstructed (for example, when the hinges 106 are turned downward and towards the hub 102), the structure has a comparatively smaller footprint than when the structure is assembled. Deconstruction may include removing the posts, brackets, feet, and/or connectors. In an embodiment, the deconstructed structure may be easily packaged for shipment, retail, or storage (for example, without the posts, which may be purchased at any hardware store).

As the invention of the present disclosure may utilize standard lumber sizes for posts 128, the junction assembly 100, the feet 200, the connectors 500, and/or the panels 400, may be easily stored or shipped without the bulky lumber components. For example, the structure may be deconstructed, enabling the user to mail the junction assembly 100, feet 200, connectors 500, and/or panels 400 to a friend or family member. In such an example, once received by the receiving party, the receiving party may simply purchase the necessary standard lumber and assemble the structure.

In an embodiment, the structural integrity of the structure is increased by virtue of the staked feet 200. Accordingly, the staked feet 200 allow the posts 128 to be sturdy and static. Each of the posts 128 may be positioned at the same angle. However, in an alternate embodiment, one or more posts 128 may be disposed at one or more angles. For example, four posts 128 may be disposed at a first angle and two posts may be disposed at a second angle. In such an embodiment, one or more styles of feet 200 may be utilized (for example, feet having feet columns angled to accept the various angles of posts). However, the posts 128 may also be staked into the ground without the feet 200. In an embodiment comprising at least a first and a second angle, the panels may provide support, holding the posts 128 in place. For example, the panels may be sufficiently strong, such that the panels, when taut, prevent the posts 128 from moving.

Accordingly, panels may be of various sizes. Panels may be provided with a first size and a second size, where the first size panels are configured to reside between posts of a first angle and the second size panels are configured to reside between posts of a second angle. However, panels may be provided of any size suitable to traverse any adjacent posts 128.

The invention as disclosure may be arranged and configured for ease of assembly, ease of disassembly, and the ability to customize or upgrade the panel arrangement. Accordingly, in such an embodiment, the structure provides a means of constantly changing its configuration, while maintaining the base hardware. Additionally, the structure is configured for a decreased footprint or folded state, wherein the cap is unscrewed, and the posts are pushed towards the structure's center, creating a collapsed easy to store version of the structure.

The invention of the present disclosure may be a temporary structure comprising a junction assembly. The junction assembly may include a hub, where the hub is an annular member having a plurality of hub walls; a plurality of hinges, each of the plurality of hinges disposed on each of the plurality of hub walls; and/or a plurality of brackets, each of the brackets swivably attached to each of the plurality of hinges, each of the brackets having at least one bracket loop, a first tine, a second tine, and a top wall. The temporary structure may further comprise a plurality of posts, each of the plurality of posts having a post top end and a post bottom end; a plurality of feet, each of the plurality of feet comprising a foot column and a base, where each of the plurality of feet are sized to accept the post bottom end and each of the plurality of brackets are sized to accept the post top end; and/or a plurality of panels, each of the plurality of panels sized to traverse one or more of the plurality of posts.

In an embodiment, each of the plurality of feet may further comprise an inner column wall, an outer column wall, and at least one side column walls, where an inner angle is formed by the base and the inner column wall, where an outer angle is formed by the base and the outer column wall, and where the inner angle is acute and the outer angle is obtuse. Further, the inner angle and outer angle may be supplementary angles. In an embodiment, each of the plurality of panels may further comprise an attachment member, the attachment member comprising an opening, a buckle, a strap, and a fastener. Each of the attachment members may be disposed on a tab, where each of the plurality of panels include one or more tabs, the one or more tabs may be disposed around a perimeter of each of the plurality of panels. Further, each of the plurality of panels further may comprise one or more recesses disposed around the perimeter of each of the plurality of panels, where each of the one or more tabs and each of the one or more tabs may be complimentary.

In an embodiment, the temporary structure may further comprise a plurality of connectors, each of the connectors configured to accept an upper post and a lower post, each of the connectors comprising a first connector member having a first connector outer wall and at least one first connector side wall, where the first connector outer wall contacts an upper post outer wall and a lower post outer wall, and where the at least one first connector side wall contacts at least one upper post side wall and at least one lower post side wall; and a second connector member have a second connector inner wall and at least one second connector side wall, where the second connector inner wall contacts an upper post inner wall and a lower post inner wall, and where the at least one second connector side wall contacts at least one upper post side wall and at least one lower post side wall.

Each of the plurality of connectors may further comprise one or more first connector outer top holes, one or more first connector outer bottom holes, one or more first connector side top holes, one or more first connector bottom holes, one or more second connector top holes, one or more second connector inner bottom holes, one or more second connector side top holes, and one or more second connector side bottom holes, where the one or more first connector outer top holes, the one or more first connector side top holes, the one or more second connector top holes, and the one or more second connector side top holes are disposed over the upper post, and where the one or more first connector outer bottom holes, the one or more first connector side bottom holes, the one or more second connector bottom holes, and the one or more second connector side bottom holes are disposed over the lower post. In an embodiment, a connector clearance is formed between the at least one first connector side wall and the at least one second connector side wall.

The temporary structure may further comprise a cap at least partially disposed atop the junction assembly, the cap having a cap top and a plurality of cap walls, where each of the cap walls are configured to limit a range of motion of the plurality of posts. In an embodiment, each of the plurality of hinges is attached, via a hinge attachment member, to the hub, and each of the plurality of hinges has a hinge tail. Moreover, each of the plurality of brackets may be swivably attached, via a bracket stem, to each of the plurality of hinges, the bracket stem may further include a bracket stem tail disposed on the top wall.

While certain novel features of the present invention have been shown and described, it will be understood that various omissions, substitutions and changes in the forms and details of the device illustrated and in its operation can be made by those skilled in the art without departing from the spirit of the invention.

What is claimed is:

1. A temporary structure comprising:

a junction assembly comprising:

a hub, wherein the hub is an annular member;

a plurality of hinges, each of the plurality of hinges disposed on the hub; and a plurality of brackets, each of the brackets swivably attached to each of the plurality of hinges, each of the brackets having at least one bracket loop, a first tine, a second tine, and a top wall;

a plurality of posts, each of the plurality of posts having a post top end and a post bottom end;

a plurality of feet, each of the plurality of feet comprising a foot column and a base, wherein each of the plurality of feet are sized to accept the post bottom end and each of the plurality of brackets are sized to accept the post top end;

a plurality of panels, each of the plurality of panels sized to traverse one or more of the plurality of posts; and a plurality of connectors, each of the connectors configured to accept an upper post and a lower post, each of the connectors comprising:

a first connector member having a first connector outer wall and at least one first connector side wall, wherein the first connector outer wall contacts an upper post outer wall and a lower post outer wall, and wherein the at least one first connector side wall contacts at least one upper post side wall and at least one lower post side wall; and a second connector member having a second connector inner wall and at least one second connector side wall, wherein the second connector inner wall contacts an upper post inner wall and a lower post inner wall, and wherein the at least one second connector side wall contacts at least one upper post side wall and at least one lower post side wall.

2. The temporary structure of claim 1, each of the plurality of feet further comprising an inner column wall, an outer column wall, and at least one side column wall, wherein an inner angle is formed by the base and the inner column wall, wherein an outer angle is formed by the base and the outer column wall, and wherein the inner angle is acute and the outer angle is obtuse.

3. The temporary structure of claim 2, wherein the inner angle and outer angle are supplementary.

4. The temporary structure of claim 1, each of the plurality of panels further comprising a plurality of attachment members, each of the attachment members comprising an opening, a strap, and a fastener.

5. The temporary structure of claim 4, wherein each of the attachment members is disposed on a tab, wherein each of the plurality of panels comprise one or more tabs, the one or more tabs disposed around a perimeter of each of the plurality of panels.

6. The temporary structure of claim 1, each of the plurality of connectors further comprising: a first connector member comprising: one or more first connector outer top holes, one or more first connector outer bottom holes, one or more first connector side top holes, one or more first connector bottom holes; and a second connector member comprising: one or more second connector inner top holes, one or more second connector inner bottom holes, one or more second connector side top holes, and one or more second connector side bottom holes, wherein the one or more first connector outer top holes, the one or more first connector side top holes, the one or more second connector inner top holes, and the one or more second connector side top holes are disposed over the upper post, and wherein the one or more first connector outer bottom holes, the one or more first connector side bottom holes, the one or more second connector inner bottom holes, and the one or more second connector side bottom holes are disposed over the lower post.

7. The temporary structure of claim 6, wherein a connector clearance is formed between the at least one first connector side wall and the at least one second connector side wall.

8. The temporary structure of claim 1, wherein each of the plurality of hinges are attached, via a hinge attachment member, to the hub, and wherein each of the plurality of hinges have a hinge tail.

9. The temporary structure of claim 1, wherein each of the plurality of brackets are swivably attached, via a bracket stem, to a corresponding hinge of the plurality of hinges, the bracket stem further comprising a bracket stem tail disposed on the top wall.

10. A temporary structure comprising:

a junction assembly comprising:

a hub, wherein the hub is an annular member;

a plurality of hinges, each of the plurality of hinges disposed on the hub; and a plurality of brackets, each of the brackets having at least one bracket loop, a first tine, a second tine, and a top wall and each of the brackets swivably attached, via a bracket stem, to a corresponding hinge of the plurality of hinges, the bracket stem further comprising a bracket stem tail disposed on the top wall;

a plurality of posts, each of the plurality of posts having a post top end and a post bottom end;

a plurality of feet, each of the plurality of feet comprising a foot column and a base, wherein each of the plurality of feet are sized to accept the post bottom end and each of the plurality of brackets are sized to accept the post top end; and a plurality of panels, each of the plurality of panels sized to traverse one or more of the plurality of posts.

11. The temporary structure of claim 10, each of the plurality of feet further comprising an inner column wall, an outer column wall, and at least one side column wall, wherein an inner angle is formed by the base and the inner column wall, wherein an outer angle is formed by the base and the outer column wall, and wherein the inner angle is acute and the outer angle is obtuse.

12. The temporary structure of claim 11, wherein the inner angle and outer angle are supplementary.

13. The temporary structure of claim 10, each of the plurality of panels further comprising a plurality of attachment members, each of the attachment members comprising an opening, a strap, and a fastener.

14. The temporary structure of claim 13, wherein each of the attachment members is disposed on a tab, wherein each of the plurality of panels comprise one or more tabs, the one or more tabs disposed around a perimeter of each of the plurality of panels.

15. The temporary structure of claim 10, further comprising a plurality of connectors, each of the connectors configured to accept an upper post and a lower post, each of the connectors comprising:

a first connector member having a first connector outer wall and at least one first connector side wall, wherein the first connector outer wall contacts an upper post outer wall and a lower post outer wall, and wherein the at least one first connector side wall contacts at least one upper post side wall and at least one lower post side wall; and a second connector member having a second connector inner wall and at least one second connector side wall, wherein the second connector inner wall contacts an upper post inner wall and a lower post inner wall, and wherein the at least one second connector side wall contacts at least one upper post side wall and at least one lower post side wall.

16. The temporary structure of claim 15, each of the plurality of connectors further comprising: a first connector member comprising: one or more first connector outer top holes, one or more first connector outer bottom holes, one or more first connector side top holes, one or more first connector bottom holes; and a second connector member comprising: one or more second connector inner top holes, one or more second connector inner bottom holes, one or more second connector side top holes, and one or more second connector side bottom holes, wherein the one or more first connector outer top holes, the one or more first connector side top holes, the one or more second connector inner top holes, and the one or more second connector side top holes are disposed over the upper post, and wherein the one or more first connector outer bottom holes, the one or more first connector side bottom holes, the one or more second connector inner bottom holes, and the one or more second connector side bottom holes are disposed over the lower post.

17. The temporary structure of claim 16, wherein a connector clearance is formed between the at least one first connector side wall and the at least one second connector side wall.

18. The temporary structure of claim 10, wherein each of the plurality of hinges are attached, via a hinge attachment member, to the hub, and wherein each of the plurality of hinges have a hinge tail.

* * * * *